US005653586A

United States Patent [19]

Arai et al.

[11] Patent Number: 5,653,586

[45] Date of Patent: Aug. 5, 1997

[54] CURING DEVICE

[75] Inventors: Mitsuo Arai, Oume; Toshiharu Suganuma, Musashimurayama, both of Japan

[73] Assignee: Kabushiki Kaisha Shinkawa, Tokyo, Japan

[21] Appl. No.: 561,400

[22] Filed: Nov. 21, 1995

[30] Foreign Application Priority Data

Nov. 25, 1994 [JP] Japan ..... 6-314282

[51] Int. Cl.[6] ..... F27B 9/00

[52] U.S. Cl. ..... 432/121; 414/156; 198/750.1

[58] Field of Search ..... 432/121, 143; 198/817, 750.1, 752.1; 414/156

[56] References Cited

U.S. PATENT DOCUMENTS 4,591,044 5/1986 Ogami et al. ..... 198/817

5,154,604 10/1992 Arai .

5,267,853 12/1993 Arai .

FOREIGN PATENT DOCUMENTS 6-19546 5/1994 Japan .

*Primary Examiner*—Noah P. Kamen

*Attorney, Agent, or Firm*—Koda and Androlia

[57] ABSTRACT

A curing device for drying bonding material used for bonding, for example, chips to a lead frame for semiconductor devices including reciprocatory motion drive pulleys provided on the drive shafts of a conveyor. A plurality of wire ropes are installed on the pulleys, and end fittings are attached to the ropes so as to be fitted to the reciprocatory motion drive pulleys. Thus, the positional relationship between the wire ropes and the reciprocatory motion drive pulleys are not changed, and the workpieces are correctly carried by the wire ropes onto heating blocks of the curing device.

2 Claims, 9 Drawing Sheets

CURING DEVICE

BACKGROUND OF THE INVENTION

1. Field of the Invention

The present invention relates to a curing device which dries the paste which is used to bond chips to lead frames.

2. Prior Art

Examples of conventional curing devices are disclosed in Japanese Utility Model Application Publication (Kokoku) No. 6-19546, Japanese Patent Application Laid-Open (Kokai) Nos. 4-5838 and 5-109792, etc.

In these curing devices, a plurality of prismatic heating blocks which heat the workpieces are installed at equal intervals along the conveying direction of the workpieces. In addition, as shown in Japanese Patent Application Laid-Open (Kokai) No. 5-109792, the workpieces are successively placed on the surfaces of the heating blocks by the tact-feeding operation of a conveyor. In this conveyor, wire ropes are used. The wire ropes are installed on pulleys which are respectively installed at the workpiece entry end and workpiece exit end of the conveyor. The pulleys at one end are fastened to a drive shaft which is driven by a motor.

Accordingly, after the conveyor is raised, the wire ropes are fed by a fixed amount; and when the conveyor is lowered, the workpiece is transferred onto the surface of a heating block. The conveyor is then temporarily stopped so that the workpiece is heated. Afterward, the conveyor is raised so as to lift the workpiece from the surface of the heating block by the wire ropes. Next, the wire ropes are fed by a fixed amount, and the conveyor is then lowered so that the workpiece is conveyed onto the surface of the next heating block. As a result of this tact-feeding operation, the workpiece is successively conveyed from the workpiece entry point to the workpiece exit point.

In the prior art described above, the wire ropes are installed on pulleys which are fastened to the drive shaft, and the pulleys and wire ropes are in a state of frictional engagement. Accordingly, when the pulleys are rotated by the drive shaft so that the wire ropes are fed by a fixed amount, the wire ropes tend to slip on the drive pulleys, thereby causing the amount by which the wire ropes are fed to fluctuate. If the wire ropes are not fed by a predetermined fixed amount, the workpieces will not be placed in prescribed positions on the heating blocks, and this can lead to variation in drying quality. Furthermore, since the workpieces are conveyed by a plurality of wire ropes, variation in the amount by which the respective wire ropes are fed causes the workpieces to be positioned obliquely on the heating blocks; thus, there may be variation in the drying quality within a single workpiece.

One conceivable method of reducing slippage between the wires and the pulleys rotated by the drive shaft is to cross the wires by winding the wires around the pulleys one and a half times or more. However, with this method, it is still difficult to completely prevent wire slippage. Furthermore, if the wires are crossed, the feeding of the workpieces becomes intermittent, causing a kerchunk noise, and wire breakage tends to occur due to wire-to-wire abrasion.

SUMMARY OF THE INVENTION

Accordingly, the first object of the present invention is to provide a curing device which can feed the workpieces by a fixed amount at all times.

The second object of the present invention is to provide a curing device which involves no crossing of the wires, thus preventing wire breakage.

The objects of the present invention are accomplished by a unique structure for a curing device which includes:

a plurality of heating blocks which are spacedly installed in the conveying direction of workpieces in which chips are bonded to lead frames by a paste, and a conveying means which conveys the workpieces by tact-feeding the workpieces so that the workpieces are successively placed on the surfaces of the heating blocks, the conveying means comprising a conveyor which can be raised and lowered and includes wire ropes installed on pulleys that are respectively provided at the workpiece entry end and workpiece exit end of the conveyor, and the unique structure of the present invention is that reciprocatory motion drive pulleys are provided on the drive shaft of the conveyor, the wire ropes are fitted to the reciprocatory motion drive pulleys so that the relative positions of the wire ropes and reciprocatory motion drive pulleys are unchanged, and a motor is provided so as to drive the drive shaft in the forward and reverse directions.

Furthermore, the objects of the present invention are accomplished by another unique structure wherein in the structure described above, first and second pulley grooves are formed in each of the reciprocatory motion drive pulleys, and one side of each of the wire ropes, which are installed on the reciprocatory motion drive pulleys so that the relative positions of the wire ropes and reciprocatory motion drive pulleys are fixed and not changeable, is disposed in the first pulley groove, while the other side of the rope is installed in the second pulley groove.

In the present invention, the wire ropes are disposed on the reciprocatory motion drive pulleys so that the relative positions of such wire ropes are unchangeable with respect to the reciprocatory motion drive pulleys. Accordingly, no positional shift occurs between the wire ropes and the reciprocatory motion drive pulleys, and the wire ropes are always moved by an amount which is proportional to the amount of rotation of the reciprocatory motion drive pulleys. In other words, the workpieces are always fed by a fixed amount or distance, and the positional shifts of the workpieces with respect to the heating blocks are prevented.

In addition, in the present invention, the first and second pulley grooves are formed in each of the reciprocatory motion drive pulleys, and one side of each of the wire ropes installed on the reciprocatory motion drive pulleys is disposed in the first pulley groove, and the other side of the wire rope is disposed in the second pulley groove. Accordingly, the rotation of the reciprocatory motion drive pulleys in the forward and reverse directions do not cause the wire ropes installed on the reciprocatory motion drive pulleys to cross each other.

DETAILED DESCRIPTION OF THE INVENTION

One embodiment of the present invention will be described below with reference to FIGS. 1 through 13.

Figure 1:
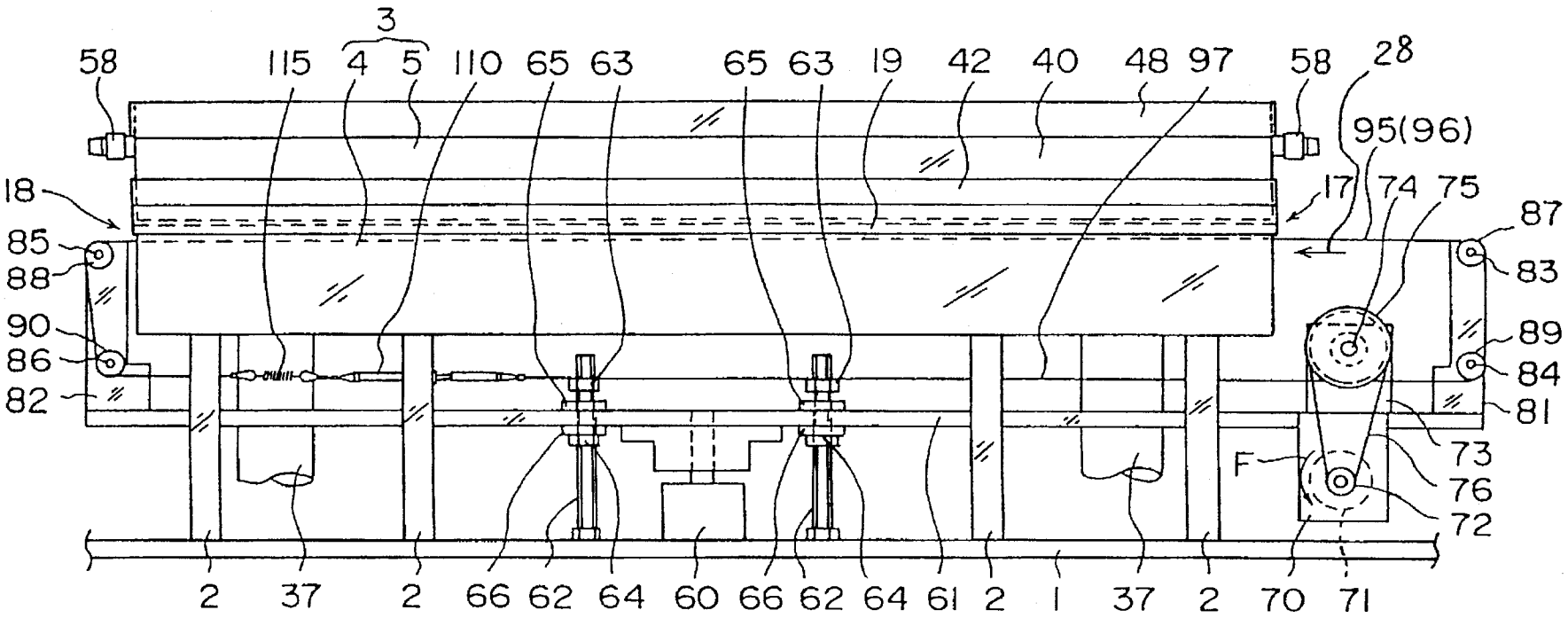
FIG. 1 is a front view of one embodiment of the curing device according to the present invention.
Figure 2:
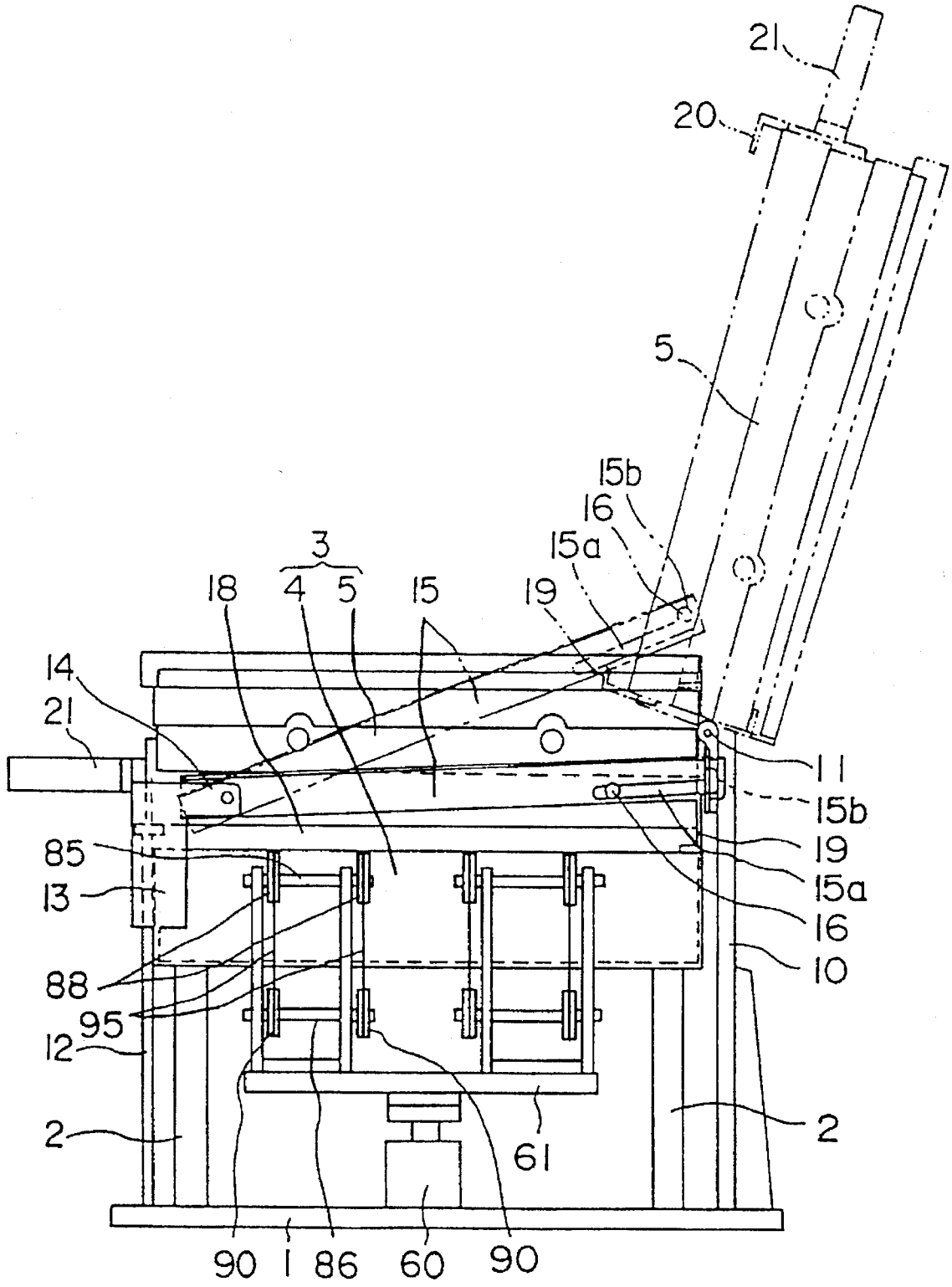
FIG. 2 is a left-side view thereof.

As shown in FIGS. 1 and 2, a casing 3 is provided on base stand 1 via a plurality of supporting columns 2 which are erected on the base stand 1. The casing 3 consists of a workpiece heating chamber casing 4, which is secured to the supporting columns 2 and a gas supply chamber casing 5, which is provided so as to freely open and close with respect to the workpiece heating chamber casing 4.

The open-and-close structure of the gas supply chamber casing 5 will be described with reference to FIG. 2.

Supporting columns 10 which support the gas supply chamber casing 5 are vertically provided on both ends (right and left ends when viewed in FIG. 1) of the front side (right side in FIG. 2) of the base stand 1, and pins 11 are fastened to the top ends of the supporting columns 10. The supporting columns 10 are parallel to the front side of the workpiece heating chamber casing 4. The front side of the gas supply chamber casing 5 is rotatably connected to the pins 11 so that the gas supply chamber casing 5 is free to change its position from the solid line (closed) position to the two-dotted line (opened) position in FIG. 2.

Furthermore, supporting plates 12 (only one shown in FIG. 2) are fastened to both ends (right and left ends when viewed in FIG. 1) of the rear side of the base stand 1, and L-shaped supporting plates 13 (only one shown) are fastened to the supporting plates 12 so that the L-shaped supporting plates 13 are positioned on both side portions of the gas supply chamber casing 5 when the casing 5 is in a closed position as indicated by the solid lines in the FIG. 2. Pins 14 (only one shown) are fastened to one end of each of these L-shaped supporting plates 13, and one end of each of locking levers 15 (only one shown) are connected at one end thereof to the pins 14 so that the locking levers 15 are rotatable about the pins 14. An elongated groove 15*a* and a locking groove 15*b* are formed continuously in the opposite end of each of the locking levers 15. The elongated groove 15*a* extends at right angles in the direction of length of the locking lever 15, and the locking groove 15*b* extends upward from one end (or the front end which is on the right side in FIG. 2) of the elongated groove 15*a*. Pins 16 fastened to the side surfaces of the gas supply chamber casing 5 are engaged with these grooves 15*a* and 15*b*.

A front cover 19 and a rear cover 20 are fastened to the front and rear ends of the gas supply chamber casing 5 so that when the gas supply chamber casing 5 is closed, the front and rear ends thereof come into contact with the front and rear edges of the workpiece heating chamber casing 4 and so that a workpiece entry port 17 and a workpiece exit port 18 are formed at one end (right end in FIG. 4) of the casing 5 and at another end (left end in FIG. 4) of the casing 5, respectively. The gas supply chamber casing 5 is further provided with a handle 21 on the rear side thereof, which is used when the casing 5 is opened and closed.

With the above structure, if the handle 21 is lifted upward from the position indicated by the solid lines in FIG. 2, the gas supply chamber casing 5 is pivoted about the pins 11 and shifted into the open position which is shown by the two-dot chain line. Thus, the upper area of the workpiece heating chamber casing 4 is uncovered.

When the gas supply chamber casing 5 is thus opened, the pins 16 fastened thereto are moved in the elongated grooves 15*a*; and when the pins 16 reach the locking grooves 15*b* and are engaged with them, the gas supply chamber casing 5 is restricted from opening further, and the pins 16 engaged with the locking grooves 15*b* can keep the gas supply chamber casing 5 opened by the locking levers 15.

In order to close the gas supply chamber casing 5, the tip end portions of the locking levers 15 are pushed slightly upward. This causes the pins 16 to disengage from the locking grooves 15*b* and move the pins 16 into the elongated grooves 15*a*. Then, the handle 21 is brought downwardly until the front cover 19 and rear cover 20 make tight contact with the workpiece heating chamber casing 4. The gas supply chamber casing 5 can thus be securely closed.

The structure inside the workpiece heating chamber casing 4 will be described particularly with reference to FIGS. 4, 5 and 7.

Figure 7:
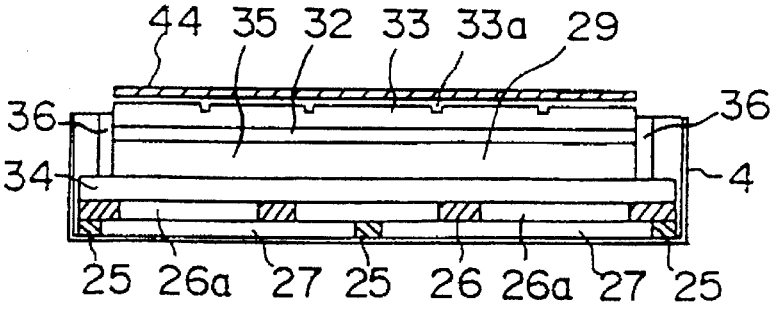
FIG. 7 shows a vertical cross section of the workpiece heating chamber casing taken along the line 7—7 in FIG. 5.

Three long, slender spacers 25*a*, 25*b* and 25*c* are, as best seen in FIG. 7, provided on the bottom surface inside the workpiece heating chamber casing 4 so that they are at the front, center and rear positions inside the casing 4, respectively, and extend from near the workpiece entry port 17 to near the workpiece exit port 18. In addition, a single heating block supporting plate 26 is provided on the upper surfaces of these spacers 25. With this heating block supporting plate 26, spaces 27 are formed between the heating block supporting plate 26 and the bottom surface of the workpiece heating chamber casing 4.

Figure 4:
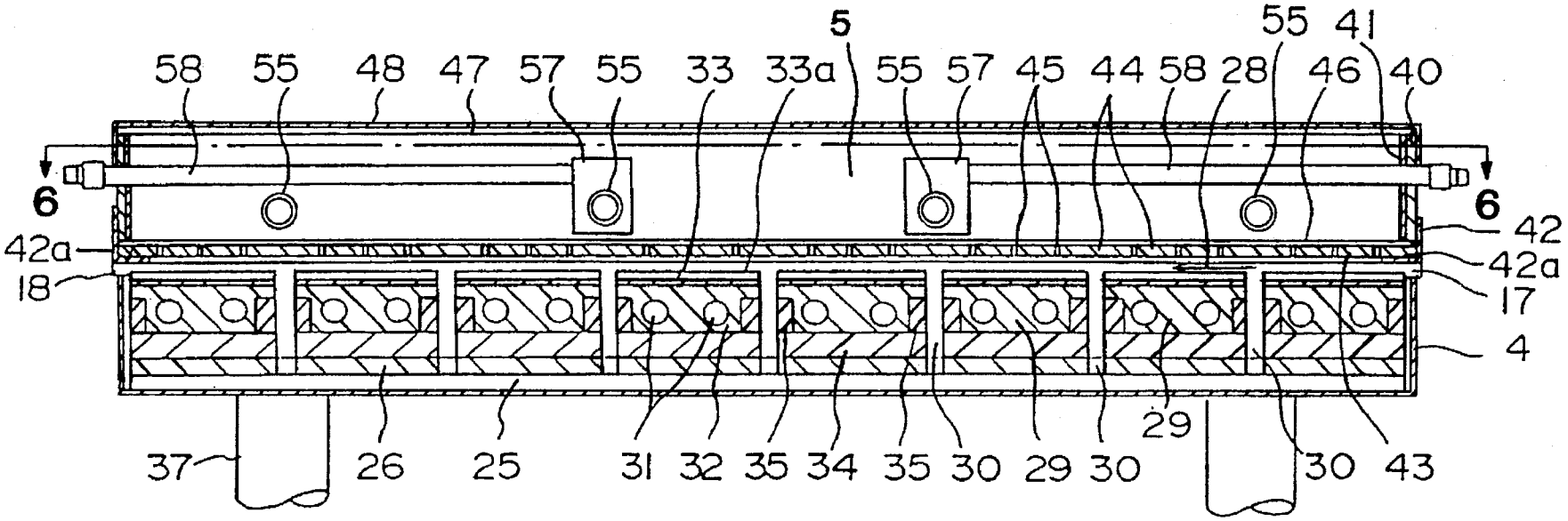
FIG. 4 is a vertical cross section of the casings used in the curing device of FIG. 1.
Figure 5:
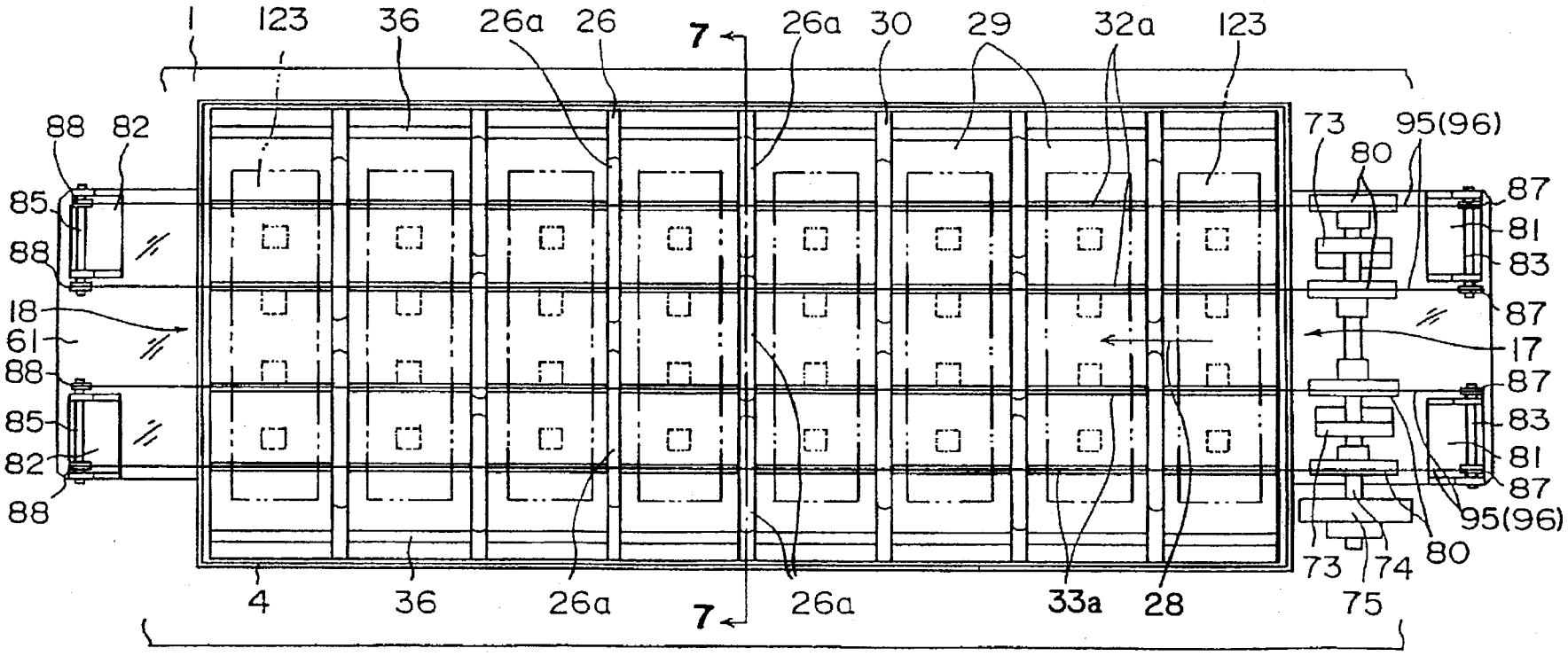
FIG. 5 is a top view of the workpiece heating chamber casing and workpiece conveying means of the curing device of FIG. 1.

A plurality of heating blocks 29 (eight heating blocks in this embodiment as shown in FIGS. 4 and 5) are disposed parallel to each other on the heating block supporting plate 26. They are placed side by side in the direction in which the workpiece is conveyed as is shown by arrow 28. In other words, the heating blocks 29 are installed in a direction from the workpiece entry port 17 to the workpiece exit port 18 with gaps 30 therebetween.

The heating block supporting plate 26 described above is provided with a plurality of elongated slots 26*a* so that the gaps 30 between the heating blocks 29 communicate with the spaces 27 which are formed under the supporting plate 26.

Each of the heating blocks 29 comprises a heating block main body 32. The heating block main body 32 is provided with two heaters 31, which are embedded therein, and a hot plate 33, which is fastened to the top surface of the main body 32. In addition, adiabatic plates 34, 35 and 36 are attached to the heating block main body 32. In particular, the bottom adiabatic plate 34 is fastened to the undersurface of the heating block main body 32, two side adiabatic plates 35 are fastened to both side surfaces of the heating block main body 32 so that they are oriented in the workpiece conveying direction 28, and other two adiabatic plates 36 are fastened to both side surfaces of the heating block main body 32 so that they are oriented in the direction perpendicular to the workpiece conveying direction 28. Moreover, as best seen in FIG. 7, a plurality of feed wire grooves 33*a* (four feed wire grooves in this embodiment) are formed in the upper surface of each hot plate 33 so that they extend in the workpiece conveying direction 28.

The workpiece heating chamber casing 4 is further provided with gas discharge pipes 37. The gas discharge pipes 37 open into the spaces 27 which are located under the heat block supporting plate 26.

The structure of the gas supply chamber casing 5 will be described next with reference to FIGS. 4 and 6.

The gas supply chamber casing 5 is comprised of a rectangular main frame 40, a lower cover 42 and a top cover 48.

Figure 6:
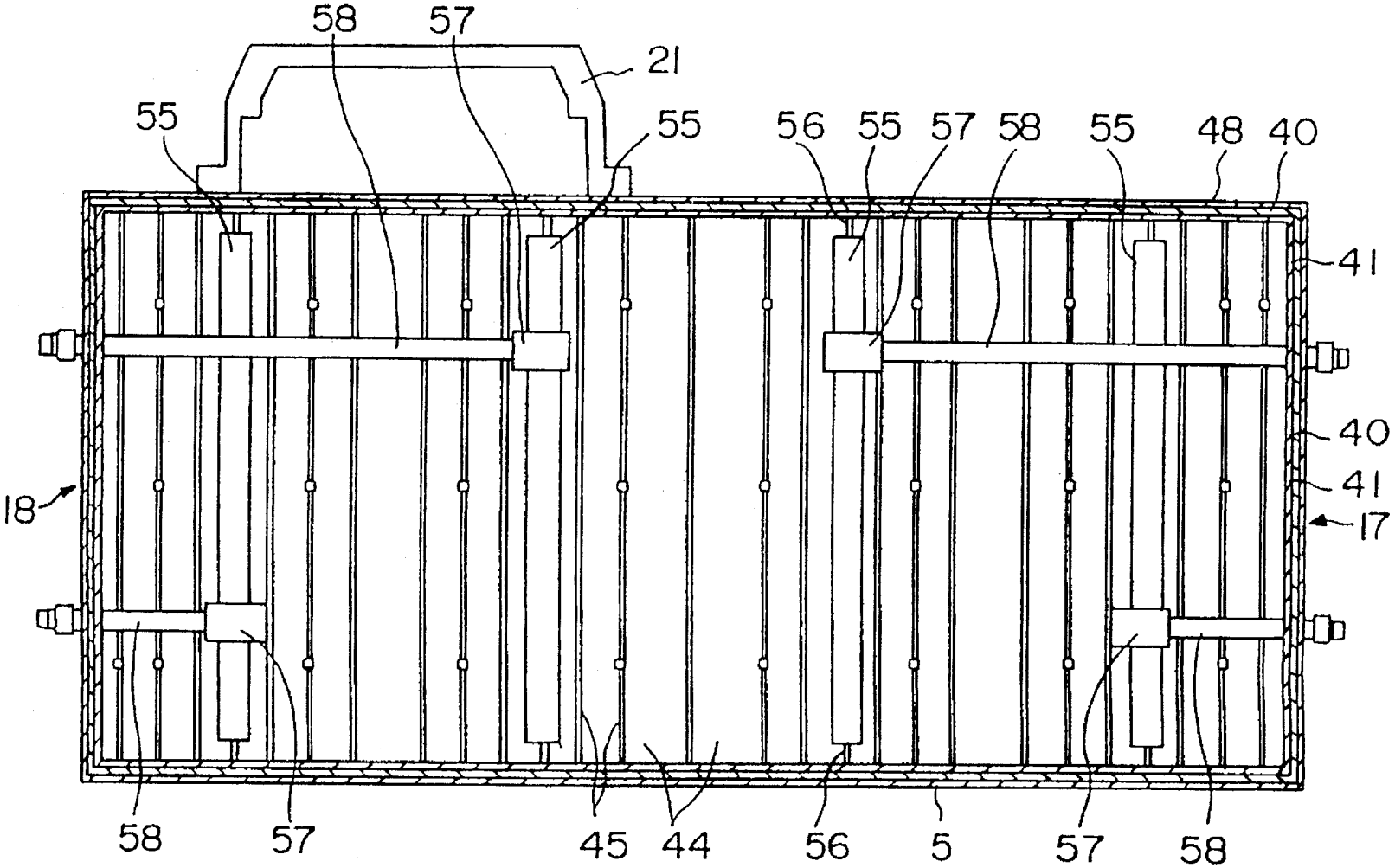
FIG. 6 is a horizontal cross section taken along the line 6—6 in FIG. 4.

The main frame 40 is open at the top and bottom, and as best seen in FIG. 6 adiabatic plates 41 are attached to the entire inner surface of the main frame 40.

The lower cover 42, as seen from FIG. 4, has a flange part 42*a* and is attached to the lower open area of the main frame 40, and gas supply slit forming plates 44 made of heat-resistant transparent glass are fastened to the flange part 42*a* with rubber packing 43 in between. The slit forming plates 44 are disposed parallel to each other in a row in the workpiece conveying direction 28 so that gas supply slits 45 are formed therebetween. The gas supply slits 45 positionally correspond to the heating blocks 29. In other words, the slit forming plates 44 are disposed so that the gas supply slits 45 formed between them are located above the heating blocks 29 and face them as best seen in FIG. 4. The lower cover 42 to which the slit forming plates 44 are disposed is fastened to the main frame 40 with a rubber packing 46 in between.

The top cover 48 is transparent and is fastened to the main frame 40 with a rubber packing 47 in between, thus covering the upper open area of the main frame 40.

Next, the structure of a gas supplying means which supplies gas to the interior of the gas supply chamber casing 5 will be described.

As best shown in FIG. 6, four (4) gas emitting pipes 55, each of them being closed at both ends, are installed inside the gas supply chamber casing 5 by supporting shafts 56. These supporting shafts 56 are secured to both ends of each gas emitting pipe 55 and also to the main frame 40 of the chamber casing 5 with the adiabatic plate 41 in between. Gas emitting holes (not shown) are opened in each of the gas emitting pipes 55. A connecting block 57 is fastened to each of the gas emitting pipes 55 so that the connecting block 57 communicates with each pipe 55, and one end of each heater-equipped gas introduction pipes 58, which are fastened to the main frame 40, is connected to each of the connecting blocks 57.

As seen from FIG. 6, the gas introduction pipes 58 for the gas emitting pipes 55 which are provided closer to the workpiece entry port 17 (located on the right half in FIG. 6) extend toward the workpiece entry port 17, and the gas introduction pipes 58 for the gas emitting pipes 55 which are provided closer to the workpiece exit port 18 (located on the left half in FIG. 6) extend toward the workpiece exit port 18.

A gas supply source (not shown) is connected to the gas introduction pipes 58, and gas transfer holes (not shown) are formed between the connecting blocks 57 and the gas emitting pipes 55 so that the gas is supplied from the gas introduction pipes 58 into the gas emitting pipes 55 through the gas transfer holes.

Next, the workpiece conveying means will be described with reference to FIGS. 1 through 3 and FIG. 5.

An air cylinder 60 is mounted on the base stand 1 so that it is roughly beneath the center of the workpiece heating chamber casing 4, and a vertically movable plate 61 is fastened to the operating rod of the air cylinder 60.

The movable plate 61 is fitted loosely over the upright bolts 62 which are installed on the base stand 1. Upper-limit stopper nuts 63 and lower-limit stopper nuts 64 are screwed to these upright bolts 62 so that they are located above and below the movable plate 61.

Furthermore, upper and lower stopper cushions 65 and 66 are fitted loosely on the upright bolts 62. The upper stopper cushions 65 are disposed between the movable plate 61 and the upper-limit stopper nuts 63, and the lower stopper cushions 66 are disposed between the movable plate 61 and the lower-limit stopper nuts 64.

A drive motor 71 is mounted on a bracket 70 which is provided on the movable plate 61 at one end near the workpiece entry port 17. A timing pulley 72 is connected to the output shaft of the drive motor 71. A plurality of shaft supporting plates 73 are also provided on the upper surface of the movable plate 61, as best seen in FIG. 5, so that the shaft supporting plates 73 are located near the workpiece entry port 17, and a drive shaft 74 is rotatably supported on the shaft supporting plates 73. A timing pulley 75 is fastened to one end of the drive shaft 74, and a timing belt 76 is installed between this timing pulley 75 and the timing pulley 72 of the output shaft of the drive motor 71.

Reciprocatory motion drive pulleys 80 (four drive pulleys 80 in this embodiment) are mounted on the drive shaft 74 so that they positionally correspond to the feed wire grooves 33*a* of the hot plates 33.

Figure 8A:
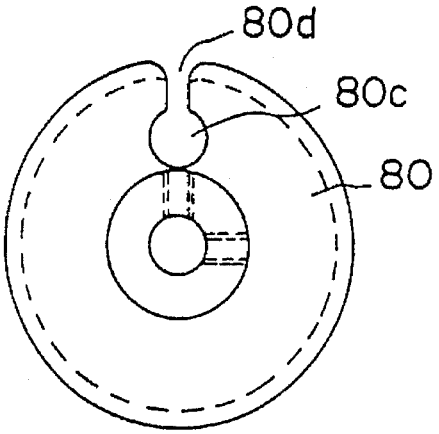
FIG. 8 shows a drive pulley used in the curing device of the present invention, wherein FIG. 8(*a*) is a front view thereof, and FIG. 8(*b*) is a top view thereof.
Figure 8B:
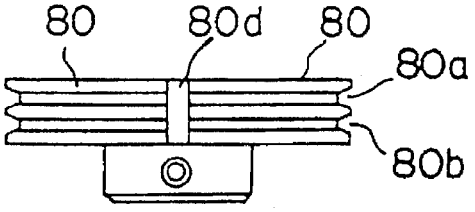

FIG. 8 shows one of the drive pulleys 80. As seen from FIG. 8(*b*), the drive pulley 80 has two pulley grooves, a first pulley groove 80*a* and a second pulley groove 80*b*. A circular stopping hole 80*c* is, as shown in FIG. 8(*a*), formed in the drive pulley 80 so as to extend parallel to the axis of the pulley 80, and a rope insertion groove 80*d* extends radially from one edge of the stopping hole 80*c* toward the circumference of the pulley 80.

Figure 3:
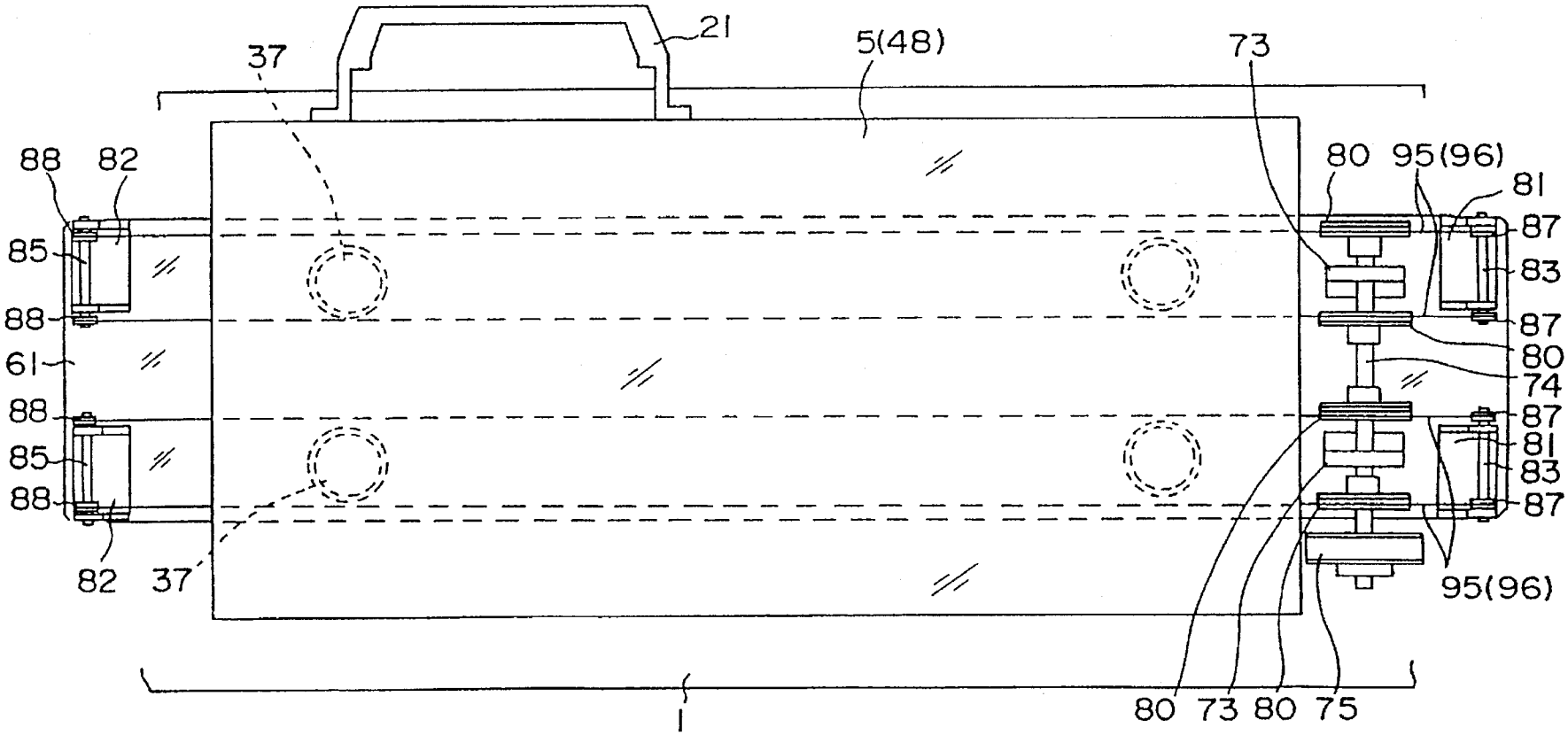
FIG. 3 is a top view thereof.

Returning now to FIGS. 1 and 5, feeding pulley supporting plates 81 and 82 are disposed on the upper surface of the movable plate 61. As best seen in FIG. 3, the feeding pulley supporting plates 81 are provided at one end of the movable plate 61 so as to be outside the drive shaft supporting plates 73 and near the workpiece entering port 17, and the feeding pulley supporting plates 82 are provided at another end of the movable plate 61 and near the workpiece exit port 18.

Four pairs of feeding pulley shafts 83, 84, 85 and 86 are rotatably provided on the feeding pulley supporting plates 81 and 82 as seen from FIGS. 1 and 5. The shafts 83 and 85 are disposed above the shafts 84 and 86, respectively as best seen in FIG. 1.

As shown in FIG. 3, two feeding pulleys 87 are attached to both ends of each pair of feeding pulley shafts 83, and two feeding pulleys 88 are attached to both ends of each pair of feeding pulley shafts 85. Likewise, two feeding pulleys 89 are attached to both ends of each pair of feeding pulley shafts 84, and two feeding pulleys 90 are attached to both ends of each pair of feeding pulley shafts 86. The feeding pulleys 89 and 90 are disposed so that they positionally correspond to or are vertically below the pulleys 87 and 88.

As seen from FIG. 5, the feeding pulleys 87 and 88 are positioned so that grooves (not shown) of these pulleys are on imaginary lines extending from the feed wire grooves 33*a* of the hot plates 33.

Figure 9:
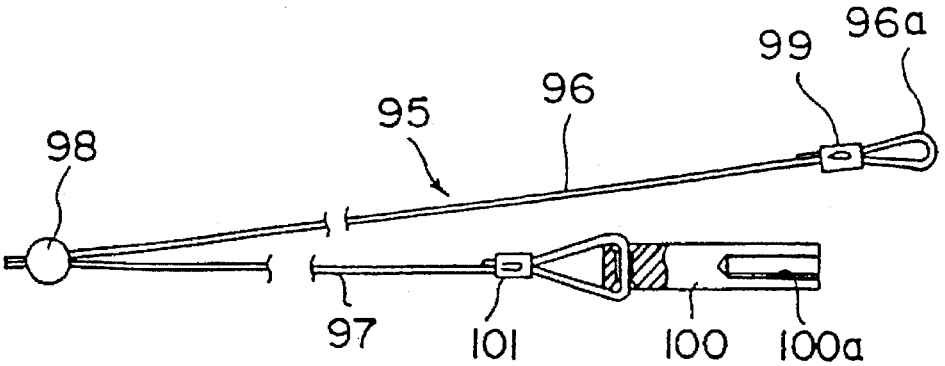
FIG. 9 is a front view of the wire rope used in the curing device of the present invention.

Feeding wire ropes 95 of the type shown in FIG. 9 are installed on the reciprocatory motion drive pulleys 80 and feeding pulleys 87 through 90. Both ends of each feeding wire rope 95 are joined by a joint 110 of the type shown in FIG. 10 so as to make a loop as shown in FIG. 11.

More specifically, the feeding wire rope 95, as shown in FIG. 9, comprises two rope elements: a first rope element 96 and a second rope element 97. One end of each of the rope elements 96 and 97 is passed through and secured to a ball-form end fitting 98 so as to make a single unit forming the feeding wire rope 95. The end fitting 98 is a ball and designed so as to be larger in diameter than the stopping hole 80*c* of the drive pulley 80. The other end of the first rope element 96 is folded back and fastened by a fastener 99 so as to form a connecting loop 96*a*. The other end of the second rope element 97 is passed through a connecting piece 100, folded back and then fastened to it by a fastener 101. The connecting piece 100 is formed with a right-handed screw 100*a* therein.

Figure 10:
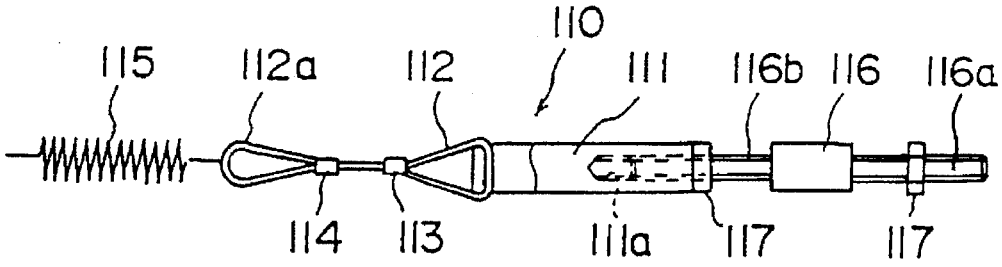
FIG. 10 is a front view of a joint for joining the ends of the wire rope.
Figure 11:
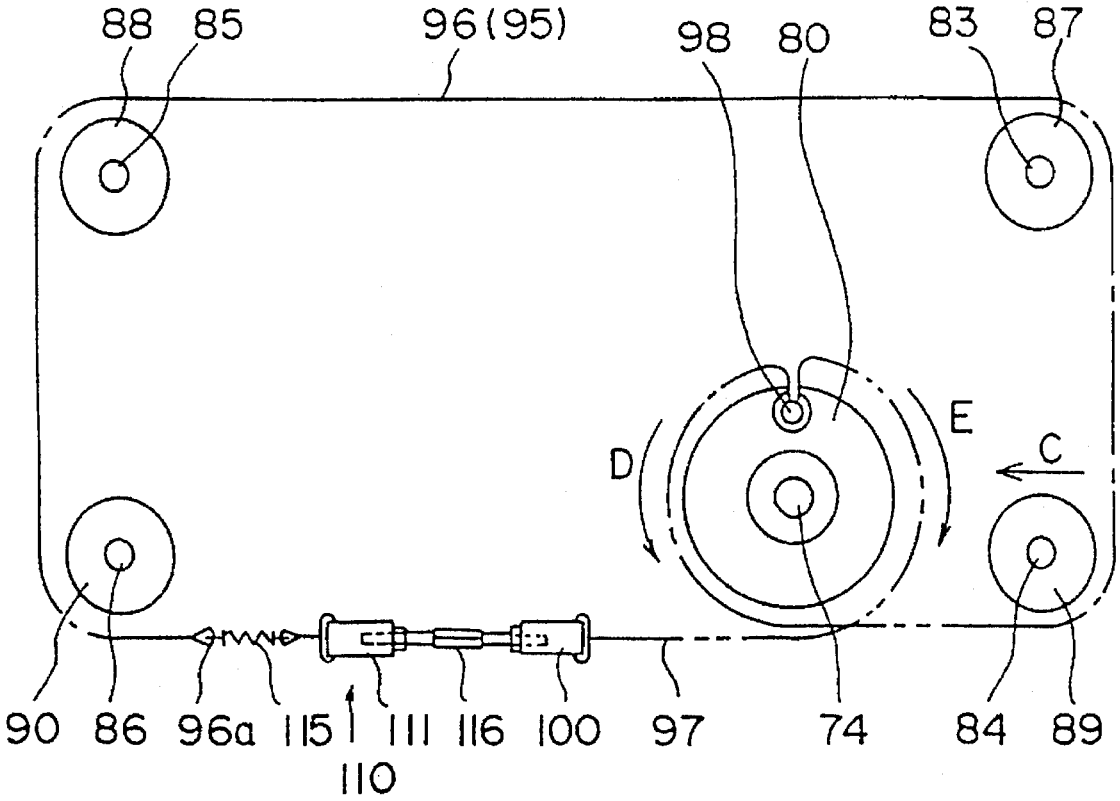
FIG. 11 is an explanatory diagram showing the installation of the wire rope around the pulleys used in the curing device of the present invention.
Figure 12:
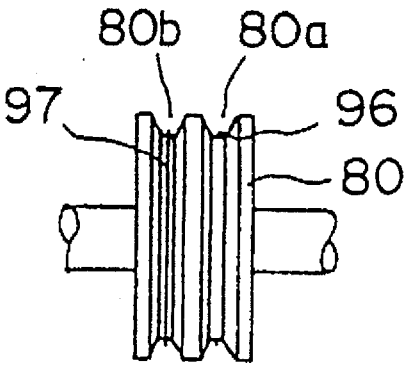
FIG. 12 shows the drive pulley viewed in the direction of arrow C in FIG. 11.

Furthermore, as seen from FIG. 10, the joint 110 includes a connecting assembly 111 which has roughly the same structure as the connecting piece 100, and a left-handed screw 111*a*, which is threaded in the opposite direction from the right-hand screw 100*a* of the connecting piece 100, is formed in the connecting assembly 111. A wire 112 is passed through the end of the connecting piece 100. One end of the wire 112 is connected to the connecting piece 100 by a fastener 113, and another end of the wire 112 is folded back and fastened to a fastener 114 to make a connecting loop 112*a*. A tension coil 115 is connected to this loop 112*a* of the wire 112 at one end thereof, and the other end of the tension coil 115 is connected to the connecting loop 96*a* of the wire rope 95 so that the wire rope 95 makes a loop as shown in FIG. 11.

The joint 110 further includes an adjustment bolt 116 which connects the connecting piece 100 and the connecting assembly 111 together. In particular, the adjustment bolt 116 includes a right-handed screw 116*a* that engages with the right-handed screw 100*a* of the connecting piece 100 and a left-handed screw 116*b* that engages with the left-handed screw 111*a* of the connecting assembly 111. In FIG. 10, the reference numeral 117 indicates a nut that prevents loosening.

The installation of the wire ropes 95 on the pulleys will be described with reference to FIGS. 9 through 11. Four wire ropes 95 are used in this embodiment as seen from FIG. 5, but the description will be made below for only one wire rope installation since the installations of all the wire ropes 95 are done in the same way.

(1) The first and second rope elements 96 and 97 are put on top of each other, and they are inserted into the stopping hole 80*c* of the drive pulley 80 through the rope insertion groove 80*d*. The end fitting 98 of the feeding wire rope 95 is positioned outside the drive pulley 80. Since the end fitting 98 is larger than the stopping hole 80*c* of the pulley 80, the feeding wire rope 95 is prevented by this end fitting 98 from slipping out of the pulley 80.

(2) The first rope element 96 is turned 180 degrees in the counterclockwise direction (i.e., the direction indicated by arrow D) in the first pulley groove 80*a* of the drive pulley 80 and then installed on the feeding pulleys 89, 87, 88 and 90 in this order. The connecting loop 96*a* at the end of the first rope element 96 is connected to the tension coil spring 115 of the joint 110.

(3) The second rope element 97 is turned 180 degrees in the clockwise direction (i.e., the direction indicated by arrow E) in the second pulley groove 80*b* of the drive pulley 80, and the connecting assembly 100 at the end of the second wire element 97 is screw-engaged with the right-handed screw 116*a* of the adjustment bolt 116 of the joint 110.

(4) The adjustment bolt 116 is turned so that an appropriate tension is applied to the tension coil spring 115, eliminating any slack in the first and second rope elements 96 and 97.

By the steps described above, the feeding wire rope 95 is installed on the drive and feeding pulleys, so that a part of the rope element 96 is located between the pulleys 87 and 88 and positionally corresponds to the feeding wire grooves 33*a* of the hot plates 33.

The other three wire ropes 95 are installed in the same way as described above so that all four wire ropes 95 are set to be parallel to each other as shown in FIG. 5.

Figure 13A:
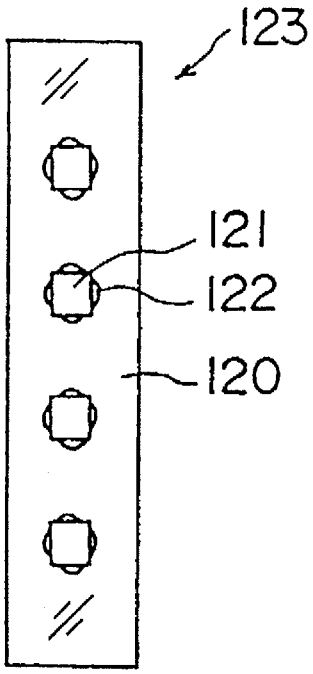
FIG. 13 illustrates an example of a workpiece worked by the curing device of the present invention, wherein FIG. 13(*a*) is a top view of the workpiece, and FIG. 13(*b*) is a front view of the workpiece.
Figure 13B:
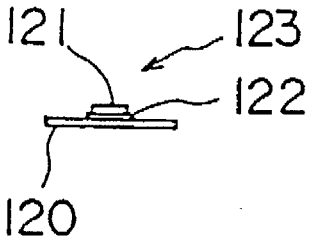

The operation of the curing device constructed as above will now be described. FIG. 13 shows an example of the workpiece treated by the curing device. This workpiece 123 is a lead frame 120 on which chips 121 are die-bonded by a paste 122 which is silver, solder, etc.

1. First, the workpiece 123 is fed in the direction of length of the workpiece 123 from a die bonder (not shown) onto the end portions (right-end portions) of the first rope elements 96 of the conveying means.

At this point, the first rope elements 96 are positioned above the feed wire grooves 33*a* of the hot plates 33. In other words, the operating rod of the air cylinder 60 is extended so that the movable plate 61 is in a raised position. Since the pulley supporting plates 81 and 82 that include the feeding pulleys 87, 89, 88 and 90 are mounted on the movable plate 61, the wire ropes 95 are in a raised position together with the movable plate 61.

2. Next, the drive motor 71 is actuated by a fixed amount in the counterclockwise direction (i.e., in the direction indicated by arrow F) in FIG. 1. As a result, the drive shaft 74 is rotated counterclockwise via the timing pulley 72, timing belt 76 and timing pulley 75, so that the first rope elements 96 of the feeding wire ropes 95 are fed by a fixed amount in the workpiece conveying direction 28 via the feeding pulleys 89, 87, 85 and 86.

3. Then, the air cylinder 60 is actuated. The operating rod of the air cylinder 60 is thus retracted so that the movable plate 61 is lowered, causing the first rope elements 96 to be brought into the feed wire grooves 33*a* of the hot plates 33 so that the workpiece 123 on the first rope elements 96 is released from the ropes 96 and placed on the hot plates 33, thus being heated.

4. The feeding movement of the workpiece 123 is temporarily stopped at this point so that the workpiece 123 is heated by the hot plate 33. During this pause period, the drive motor 71 is rotated by the fixed amount in the opposite direction from the direction of the rotation i.e., the drive motor 71 is rotated in the clockwise direction.

5. Afterward, the operating rod of the air cylinder 60 is extended so that the movable plate 61 is raised, thus lifting the workpiece 123 above the heating block 29 by the first rope elements 96.

6. Next, the drive motor 71 is again rotated by a fixed amount in the counterclockwise direction (i.e., in the direction indicated by arrow F), and the operating rod of the air cylinder 60 is retracted so that the movable plate 61 is lowered and the workpiece 123 is placed on the next hot plate 33 so as to be heated.

With the execution of the feeding operation described above, the workpiece 123 is fed successively from the heating block 29 located closest to the workpiece entry port 17 to the heating block 29 located closest to the workpiece exit port 18, thus being heated by these heating blocks so that the paste 122 is dried.

In this embodiment, the end fittings 98 which connect the first and second rope elements 96 and 97 are fitted on the reciprocatory motion drive pulleys 80 so that the relative positions of the end fittings 98 and the reciprocatory motion drive pulleys 80 are fixed and unchangeable. Accordingly, the rope elements 96 and 97 always move by an amount proportional to the amount of rotation of the reciprocatory motion drive pulleys 80 without any slippage of the rope elements 96 and 97 relative to the reciprocatory motion drive pulleys 80.

Thus, since there is no fluctuation in the amount of feeding of the first rope elements 96, the workpieces 123 are always fed by a fixed amount and are correctly placed on the heating blocks 29. Furthermore, the first and second pulley grooves 80*a* and 80*b* are formed in each reciprocatory motion drive pulley 80, and the first and second rope elements 96 and 97 are respectively installed in the first and second pulley grooves 80*a* and 80*b*; accordingly, the first rope elements 96 and second rope elements 97 do not cross even if the reciprocatory motion drive pulleys 80 rotate in the forward and reverse directions.

When the workpieces 123 are heated by the heating blocks 29, a high-temperature gas heated and supplied to the gas emitting pipes 55 by the heater-equipped gas introduction pipes 58 is blown onto the top surfaces of the workpieces 123. In particular, the high-temperature gas supplied to the gas introduction pipes 58 is blown into the gas supply chamber casing 5 through the gas emitting holes (not shown) formed in the gas emitting pipes 55. The high-temperature gas flows in a laminar flow through the gas supply slits 45 and is uniformly blown onto the surfaces of the workpieces 123.

The high-temperature gas blown onto the workpieces 123 and any harmful gases evolved from the workpieces 123 passes through the gaps 30 between the heating blocks 29 and the elongated slots 26*a* formed in the heating block supporting plate 26, and into the space 27 to be discharged to the outside of the casing 3 through the gas discharge pipes 37.

It is possible to design the present invention so that the hot plates 33 provided on the heating blocks 29 are heated at a higher temperature in the order from the blocks near the workpiece entry port 17 to the blocks near the workpiece exit port 18 as disclosed in Japanese Utility Model Application Publication (Kokoku) No. 6-19546. In other words, the respective heating blocks 29 can be separately temperature-controlled. For example, the first three heating blocks 29 from the workpiece entry port 17 are heated at 250° C., the two next heating blocks 29 are heated at 270° C., and then the remaining three heating blocks 29 are controlled to 250° C.

All the surfaces of the heating block main body 32 of each heating block 29 (except for the upper surface of the heating block main body 32) are covered by adiabatic plates 34, 35 and 36. Accordingly, there is no mutual thermal interaction between adjacent heating blocks 29. Thus, the temperature of each heating block 29 can be accurately and easily controlled.

Furthermore, in the embodiment above, the gas supply chamber casing 5 is openable with respect to the workpiece heating chamber casing 4. Accordingly, in cases where workpieces 123 are mis-conveyed (e.g., in cases where the workpieces are obliquely positioned on the wire ropes 95), or in cases where wire rope breakage has occurred, or furthermore in cases where soiled wire ropes 95 or heating blocks 29 are to be cleaned, etc., the gas supply chamber casing 5 is opened by lifting the handle 21, thus creating an access to the inside of the workpiece heating chamber casing 4 so that the problems described above can be fixed. When the casing 5 is opened, the heating blocks 29 and the wire ropes 95 of the workpiece conveying means are exposed, and mis-conveyed workpieces 123 can easily be removed or placed in an orderly fashion, the wire ropes 95 that are broken can be replaced, and the wire ropes 95 and the surfaces of the heating blocks 29, etc. can be cleaned efficiently in a short period of time, thus being able to maintain high productivity.

In the embodiment described above, the present invention is applied to a curing device in which the casing is divided into a workpiece heating chamber casing that contains a plurality of heating blocks and a gas supply chamber casing that supplies a high-temperature gas to the surfaces of the heating blocks, and the gas supply chamber casing is designed so as to open and close freely relative to the workpiece heating chamber casing. However, it goes without saying that the invention can also be applied to a curing device in which the casing includes a single box type casing as in conventional devices.

As seen from the above, according to the present invention, reciprocatory motion drive pulleys are provided on the drive shaft, and wire ropes are installed on the reciprocatory motion drive pulleys so that the positional relationship between the wire ropes and the reciprocatory motion drive pulleys are unchangeable. Accordingly, no positional shifts occur between the reciprocatory motion drive pulley and the wire ropes. Thus, the wire ropes are always moved by an amount proportional to the amount of rotation of the reciprocatory motion drive pulleys.

Furthermore, in the present invention, first and second pulley grooves are formed in each of the reciprocatory motion drive pulleys, and one side of each one of the wire ropes, which are installed on the reciprocatory motion drive pulleys so that the relative positions of the wire ropes and reciprocatory motion drive pulleys are unchanged, is disposed in the first pulley groove, and the other side of the wire rope is disposed in the second pulley groove. Accordingly, the rotation of the reciprocatory motion drive pulleys in the forward and reverse directions does not cause the wire ropes installed on the reciprocatory motion drive pulleys to cross each other, thus preventing wire breakage.

We claim:

1. A curing device comprising:

a plurality of heating blocks which are installed with gaps therebetween in a conveying direction of workpieces in which chips are bonded to lead frames by a paste; and a conveying means which conveys said workpieces by tact-feeding said workpieces so that said workpieces are successively placed on surfaces of said heating blocks said conveying means comprising a conveyor, a means for raising and lowering said conveyor and wire ropes installed on pulleys that are respectively installed at a workpiece entry end and a workpiece exit end of said conveyor; and said curing device being further characterized in that reciprocatory motion drive pulleys are provided on drive shafts of said conveyor, each of said reciprocatory motion drive pulleys is provided with first and second pulley grooves, and one side of each of said wire ropes, which are installed on said reciprocatory motion drive pulleys so that relative positions of said wire ropes and said reciprocatory motion drive pulleys are unchanged, is disposed in said first pulley groove, and another side of said each of said wire ropes is disposed in said second pulley groove; and a motor is further provided so as to drive said drive shaft in forward and reverse directions.

2. A curing device a plurality of heating blocks which are installed with gaps therebetween in a conveying direction of workpieces in which chips are bonded to lead frames by a paste; and a conveying means which conveys said workpieces by tact-feeding said workpieces so that said workpieces are successively placed on surfaces of said heating blocks, said conveying means comprising a conveyor, a means for raising and lowering said conveyor and wire ropes installed on pulleys that are respectively installed at a workpiece entry end and a workpiece exit end of said conveyor; and said curing device being further characterized in that reciprocatory motion drive pulleys are provided on drive shafts of said conveyor, each of said reciprocatory motion drive pulleys is provided with first and second pulley grooves and a stopping hole, and each of said wire ropes comprises a first side and a second side which are connected to each other via an end fitting so that said first side is disposed in said first pulley groove and said second side is disposed in said second pulley groove, said end fitting being disposed in said stopping hole thus causing said relative position of said wire rope and reciprocatory motion drive pulley to be unchanged; and a motor is further provided so as to drive said drive shaft in forward and reverse directions.

* * * * *